US009420910B2

(12) United States Patent
Yau

(10) Patent No.: US 9,420,910 B2
(45) Date of Patent: Aug. 23, 2016

(54) SNAP-ON TWIST-OFF TAG FOR A HANGER

(75) Inventor: Wai Shing Yau, Kowloon Bay (HK)

(73) Assignee: Wai Shing Yau, Hong Kong (HK)

( * ) Notice: Subject to any disclaimer, the term of this patent is extended or adjusted under 35 U.S.C. 154(b) by 808 days.

(21) Appl. No.: 13/805,378

(22) PCT Filed: Jun. 21, 2011

(86) PCT No.: PCT/IB2011/002206
§ 371 (c)(1),
(2), (4) Date: Mar. 13, 2013

(87) PCT Pub. No.: WO2012/007840
PCT Pub. Date: Jan. 19, 2012

(65) Prior Publication Data

US 2013/0200114 A1 Aug. 8, 2013

Related U.S. Application Data

(60) Provisional application No. 61/356,970, filed on Jun. 21, 2010.

(51) Int. Cl.
*A47G 25/14* (2006.01)
*G09F 3/04* (2006.01)

(52) U.S. Cl.
CPC ..... *A47G 25/1407* (2013.01); *A47G 25/1428* (2013.01); *G09F 3/04* (2013.01)

(58) Field of Classification Search
CPC ..... A47G 25/1407; A47G 25/1414; A47G 25/1428; G09F 3/04
See application file for complete search history.

(56) References Cited

U.S. PATENT DOCUMENTS

| | | | | | |
|---|---|---|---|---|---|
| 4,881,836 | A * | 11/1989 | Blanchard | A47G 25/1428 | 223/85 |
| 7,513,400 | B2 * | 4/2009 | Gouldson | A47G 25/1435 | 223/85 |
| D658,901 | S * | 5/2012 | Yau | D6/328 | |
| 2007/0062984 | A1 * | 3/2007 | Louw | A47G 25/1428 | 223/85 |
| 2008/0054029 | A1 * | 3/2008 | Ho | A47G 25/1428 | 223/88 |
| 2009/0120973 | A1 * | 5/2009 | Ho | A47G 25/1428 | 223/85 |
| 2009/0277933 | A1 * | 11/2009 | Goldman | A47G 25/1428 | 223/85 |
| 2011/0101044 | A1 * | 5/2011 | Chan | A47G 25/1428 | 223/85 |

(Continued)

FOREIGN PATENT DOCUMENTS

| | | | | |
|---|---|---|---|---|
| AU | CA 2539413 A1 * | 9/2006 | A47G 25/1407 | |
| WO | WO 8304122 A1 * | 11/1983 | A47G 25/1428 | |

*Primary Examiner* — Shaun R Hurley
*Assistant Examiner* — Andrew W Sutton
(74) *Attorney, Agent, or Firm* — David I. Roche; Baker & McKenzie LLP

(57) ABSTRACT

In one embodiment, a hanger and a snap-on-twist-off tag combination is disclosed. In this embodiment, the hanger includes a body, a boss, and a hook. The snap-on-twist-off tag (hereinafter referred to as tag) includes a top end, a bottom end, a body portion connecting the top end and the bottom end, and an opening adjacent to the top end, wherein the body is resiliently expandable. In this embodiment the tag has a locked position, wherein the tag is longitudinally aligned with the body of the hanger, wherein the tag is locked to the top portion of the hanger and cannot be moved freely in any direction, and wherein the boss of the hanger extends through the opening of the tag. The tag also has an unlocked position of the tag, wherein the tag is perpendicularly aligned with the body of the hanger, wherein the boss of the hanger extends through the opening of the of the tag, and wherein the tag is movable.

26 Claims, 8 Drawing Sheets

(56) References Cited

U.S. PATENT DOCUMENTS

2012/0067929 A1* 3/2012 Gouldson ..... A47G 25/1428 223/85
2012/0292352 A1* 11/2012 Gouldson ..... A47G 25/1428 223/85
2013/0270309 A1* 10/2013 Mainetti ..... A47G 25/1435 223/85

* cited by examiner

SNAP-ON TWIST-OFF TAG FOR A HANGER

CROSS-REFERENCE TO RELATED APPLICATIONS

This is a National Stage Application, claiming priority to PCT/IB2011/002206 filed 21 Jun. 2011, the entirety of which is incorporated herein by reference.

This application also claims the benefit of U.S. Provisional Application Ser. No. 61/356,970, filed on Jun. 21, 2010, the entirety of which is incorporated herein by reference.

TECHNICAL FIELD

The embodiments described and claimed herein relate generally to tags for hangers used for hanging garments or other objects.

BACKGROUND

Today, many garment retailers use sizers to assist in identifying a garment hanging on a hanger. Typically, a sizer has descriptive information on it (e.g., a number or indicia such as the latter(s) S, M, L, XL, among others) that relates to the garment attached to the hanger. Sizers help manufacturers, retailers and purchasers by allowing garments of a particular size to be organized, displayed and easily seen.

Sizers currently available in the market are typically made to attach to the hanger so that once a sizer is attached, it does not fall off the hanger while in transit or as customers peruse a particular garment selection. In this regard, these sizers are designed so that they are not easily removable and cannot be removed unless a tool is used to remove them from the hanger. Attempting to remove such sizers by hand typically damages either the sizer or the hanger, rendering either one or both unusable for future use.

SUMMARY

In one embodiment, a push-on-twist-off tag (tag) for a hanger is provided, wherein the tag includes a top end, a bottom end, and a body portion connecting the top end and the bottom end. The top end has at least one inwardly directed tab and at least one primary locking edge adapted to lock the tag to a corresponding locking surface on a neck portion of the hanger. Further, the top end includes an opening adjacent to the at least one inwardly directed tab adapted to receive the neck portion of the hanger, the opening having a lateral opening width and a diagonal opening dimension. The body is resiliently expandable in a direction of the lateral opening width to unlock the tag, such that the lateral opening width increases to a temporarily increased lateral opening dimension equal to at least the diagonal opening dimension upon rotation of the tag about the neck portion of the hanger to unlock the tag.

In another embodiment, a hanger and snap-on-twist-off tag (hereinafter referred to as tag) combination is disclosed. In this embodiment, the hanger includes a body, a boss, and a hook. The tag, in turn, includes a top end, a bottom end, and a body portion connecting the top end and the bottom end. The top end has at least one inwardly directed tab and at least one locking edge adapted to lock the tag to the boss of the hanger. The top end also has an opening adjacent to the locking edge adapted to receive the boss, wherein the opening has a lateral opening width that corresponds to a width of the boss and a diagonal opening dimension that corresponds to a diagonal dimension of the boss, wherein the body portion of the tag is resiliently expandable in a direction of the lateral opening width, such that the lateral opening width increases to a temporarily increased lateral opening dimension equal to at least the diagonal opening dimension upon rotation of the tag about the boss to unlock the tag In yet another embodiment, a hanger and snap-on-twist-off tag (hereinafter referred to as tag) combination is disclosed. In this embodiment, the hanger includes a body, a boss, and a hook. The tag includes a top end, a bottom end, a body portion connecting the top end and the bottom end, and an opening adjacent to the top end, wherein the body is resiliently expandable. In this embodiment the tag has a locked position, wherein the tag is longitudinally aligned with the body of the hanger, wherein the tag is locked to the top portion of the hanger and cannot be moved freely in any direction, and wherein the boss of the hanger extends through the opening of the tag. The tag also has an unlocked position of the tag, wherein the tag is perpendicularly aligned with the body of the hanger, wherein the boss of the hanger extends through the opening of the of the tag, and wherein the tag is movable.

BRIEF DESCRIPTION OF THE DRAWINGS

These and other features, aspects, objects, and advantages of the embodiments described and claimed herein will become better understood upon consideration of the following detailed description, appended claims, and accompanying drawings where:

Figure 1A:
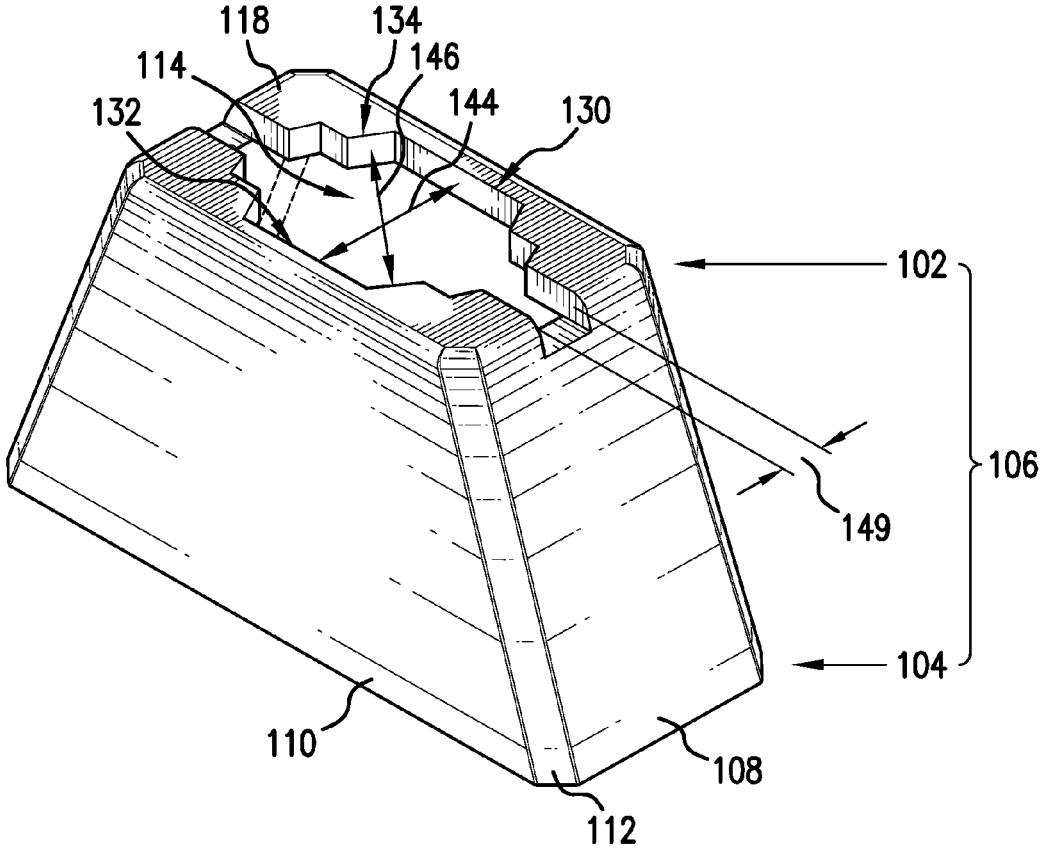
FIG. 1A is a perspective view of the snap-on-twist-off tag (referred to as tag)

It should be understood that the drawings are not necessarily to scale and that the embodiments are sometimes illustrated by graphic symbols, phantom lines, diagrammatic representations and fragmentary views. In certain instances, details which are not necessary for an understanding of the embodiments described and claimed herein or which render other details difficult to perceive may have been omitted. It should be understood, of course, that the inventions described herein are not necessarily limited to the particular embodiments illustrated. Indeed, it is expected that persons of ordinary skill in the art may devise a number of alternative configurations that are similar and equivalent to the embodiments shown and described herein without departing from the spirit and scope of the claims.

Like reference numerals will be used to refer to like or similar parts from figure to figure in the following detailed description of the drawings.

DETAILED DESCRIPTION

Referring first to FIG. 1A, an exemplary snap-on-twist-off tag 100 (hereinafter referred to as a "tag 100" or "sizer 100") is shown in perspective view. The tag 100 includes a top end 102, a bottom end 104, and a body portion 106. The top end 102, among other features, includes an opening 114, a first and second primary locking edges 130 and 132, a first secondary locking edge 134, and a first inwardly directed tab 118. The opening 114 has a lateral opening width 144 and a diagonal opening dimension 146. The body portion, in turn, has inclined sidewalls 108, parallel sidewalls 110, and beveled sidewalls 112.

Figure 1B:
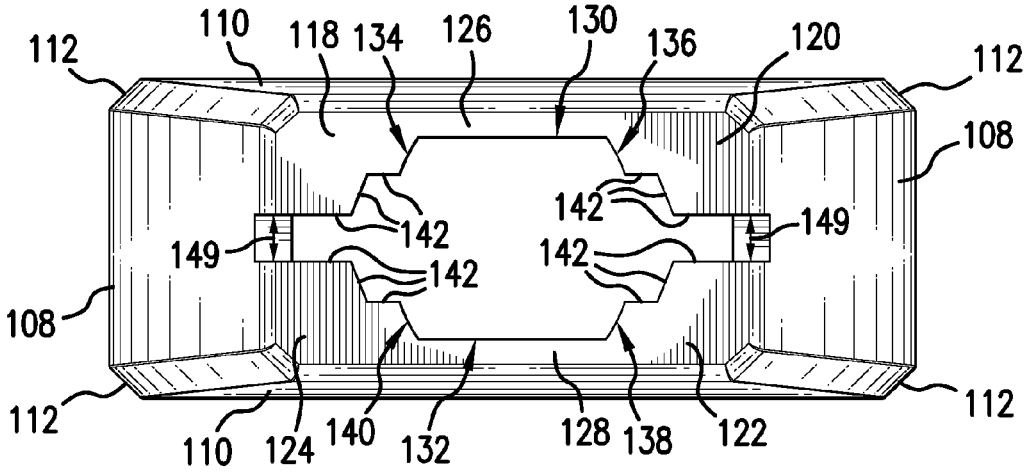
FIG. 1B is a top elevational view of same.
Figure 1C:
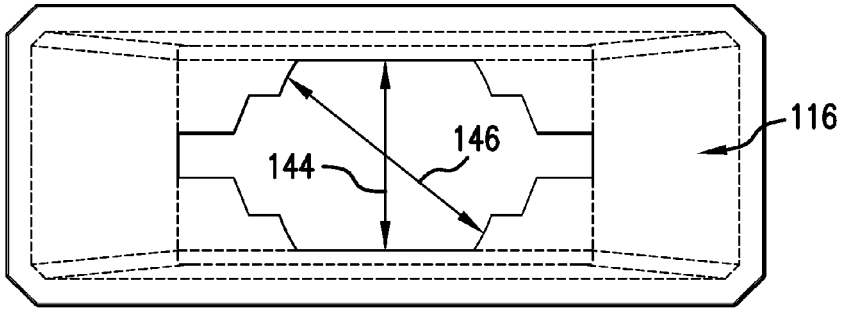
FIG. 1C is a rear elevational view of same.
Figure 1D:
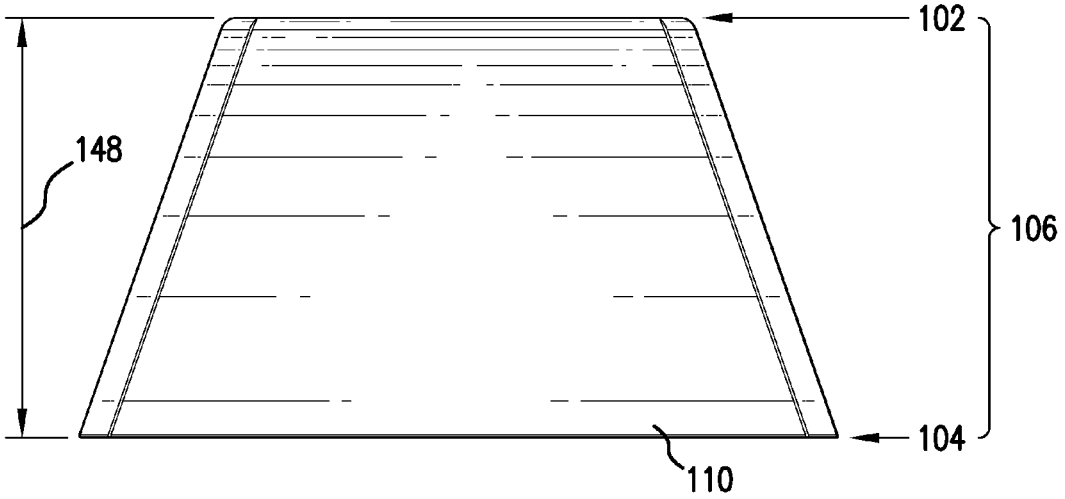
FIG. 1D is a side elevational view of same.
Figure 2A:
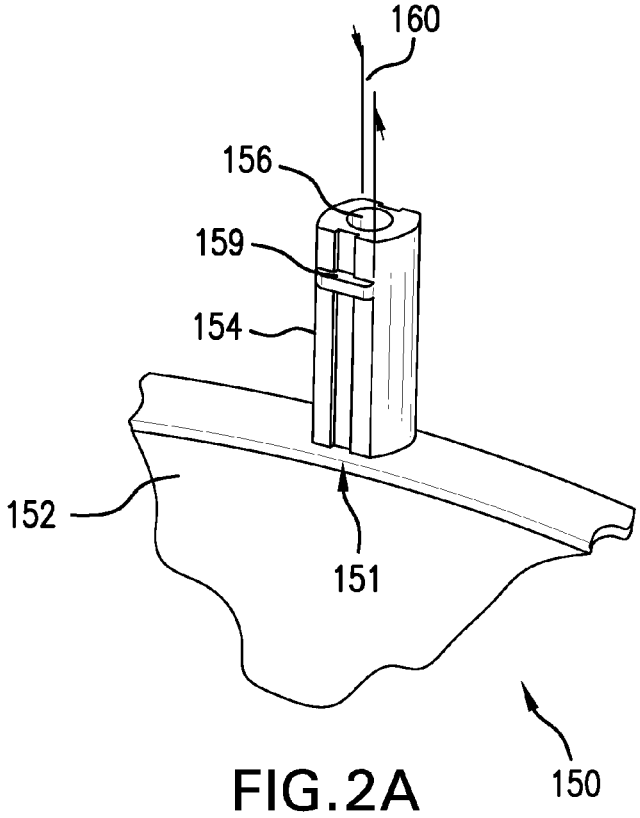
FIG. 2A is a perspective view of a hanger.
Figure 2B:
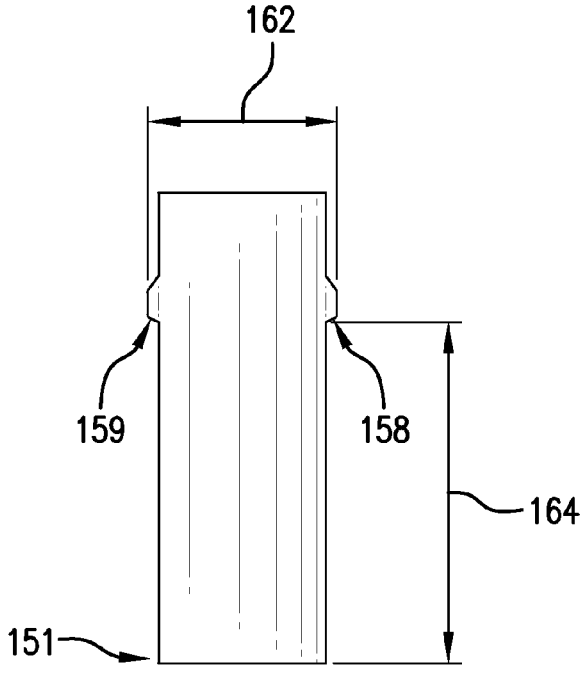
FIG. 2B is an elevational view of a neck portion of a hanger.

Before describing the features of tag 100 illustrated in FIGS. 1A-1D more fully, the components typically associated with and used in connection with the tag 100 should be noted. The tag 100 is typically used in connection with a hanger and the body portion 106 generally includes identification information of the item that is to be hanged from the hanger. FIGS. 2A-2B illustrates an exemplary embodiment of a hanger 150. The hanger 150 includes a base 151, a frame 152, a neck portion 154 (also referred to as a boss 154), and a hole 156 for receiving a hook (not shown in FIG. 2). FIG. 2B is an elevational view of the neck portion 154. The neck portion 154 includes at least one corresponding locking surface. The least one corresponding locking surface is at a right angle to the neck portion 154. As shown in FIG. 2B, the at least one corresponding locking surface is a protrusion that protrudes from the neck portion 154. In one embodiment, as shown in FIG. 2, the neck portion 154 includes a first and second corresponding locking surfaces 158 and 159, both of which are at right angles to the neck portion 154.

In one embodiment, the hanger 150 is a garment hanger for hanging different types of garments. In this embodiment, the body portion 106 includes a description relating to the garment. For instance, the body portion 106 may include a size description (e.g., S, M, L, XL) of the garment that is to be hanged. In another embodiment, the hanger 150 is a hanger for hanging different tools, such as a screw driver or a wrench. In this embodiment, the tag 100 includes a size description or other identification information relating to the tool that is to be hanged. It should be noted that as a general matter that that tag 100 is not just limited to being used in the embodiments disclosed.

Figure 8:
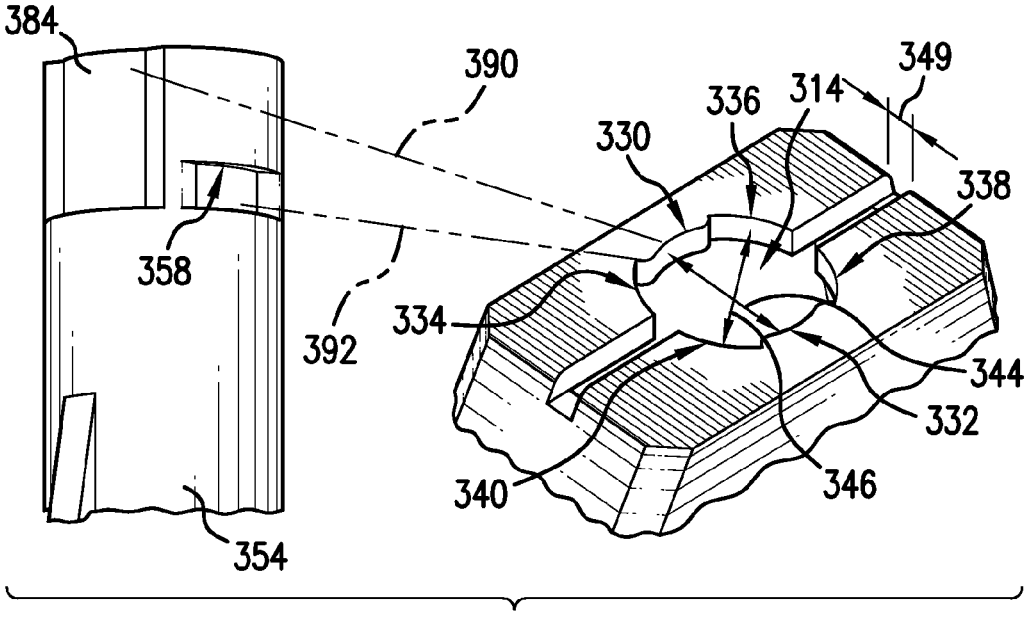
FIG. 8 is a perspective view snap-on-twist-off tag and hanger combination.

It should be understood that the neck portion 154 or the hanger 150 may include other features and is not limited to the design shown in FIGS. 2A-2B. For instance, FIG. 8 shows an alternative embodiment of a neck portion of a hanger. As shown in FIG. 8, a neck portion includes an indentation, which forms a corresponding locking surface, wherein the corresponding locking surface is at a right angle to the neck portion. In alternative embodiment, the neck portion 154 includes flanges that protrude out of the neck portion 154.

Regardless of what the tag 100 is used for, the tag 100 has at least three different positions relative to the hanger 150: an unlocked position, a locked position, and a removed or unlatched position.

In the locked position, the tag 100 is longitudinally aligned with the body of the hanger 150 and the tag 100 is locked or snapped-on to the neck portion 154. In this position, the tag 100 is pushed fully downwards so that a part of the neck portion 154 and the first and second corresponding locking surfaces 158 and 159 of the neck portion 154 are positioned above the opening 114. The first corresponding locking surface 158 engages with the first primary locking edge 130 of the tag 100 and the second corresponding locking surface 159 engages with the second primary locking edge 132 of the tag 100 to lock the tag 100 to the locked position. The first and second corresponding locking surfaces 158 and 159 prevent the tag 100 from moving from side to side or upwards. In the locked position, the tag 100 is locked to the neck portion 154 and cannot be moved freely in any direction.

Once the tag 100 is in the locked position (i.e., referred to as the locked tag 100), the locked tag 100 cannot be removed from the hanger 150 by hand by pulling it from the neck portion 154 without damaging the tag 100 or the neck portion 154 (or both). In this regard, when the locked tag 100 is pulled by hand to remove it from the neck portion 154, the first primary locking edge 130, the second primary locking edge 132, the first and second corresponding locking surfaces 158 and 159, and/or other features of the tag 100 or hanger 150 are damaged, rendering either the tag 100 or hanger 150 (or both) unusable for future use. Any of these features may break or crack when the tag 100 is pulled away from the neck portion 154 by hand.

In addition, once the tag 100 is in the locked or snapped into the hanger, squeezing or pinching the body portion 106 (e.g. pinching either the parallel side walls 110 or the inclined side walls 108) to remove tag 100 does not assist in removing the tag 100 from the neck portion 154. In fact, squeezing or pinching the body portion 106 makes it more difficult to remove the tag 100 from the neck portion 154. When the parallel sidewalls 110 of the body portion 106 are squeezed or pinched towards each other, the first primary locking edge 130 is forced towards the first corresponding locking surface 158 and the second primary locking edge 132 is forced towards the corresponding locking surface 159. In effect, each of the first and second primary locking edges engage with the first and second corresponding locking surfaces even more, resulting in a tighter engagement between the first corresponding locking surface 158 and the first primary locking edge 130 and the second corresponding locking surface 159 and the second primary locking edge 132, making it more difficult for the tag 100 to be removed from the neck portion 154.

The locked tag 100 is designed to be removed without using a removal tool by first twisting or rotating the tag 100 by 90 degrees about the neck portion 152, and then lifting it upward. The resulting position of the tag 100 after rotating it or twisting it by 90 degrees is known as the unlocked position. The tag 100 can be forced upwardly from the locked position, but only with difficulty (such as prying with a sharp tool). This is especially true because gripping the tag on the two large flat and parallel sidewalls 110 of the body portion 106 tends to make it more difficult to slide the tag upward, because compressing the body potion in a direction perpendicular to the parallel sidewalls of the body portion 106 will tend to increase the engagement of the locking edges 130 and 132 with the locking surfaces 158 and 159. It should also be noted that the inclined sidewalls 108 are not effective surfaces to grip in order to remove the tag 100, because the sloping and smooth nature of surfaces of inclined sidewalls 108 makes it difficult to apply any significant upward force to the tag 100.

In the unlocked position, the tag 100 is perpendicularly aligned with the frame 152 and tag 100 is movable. In this position, the first and second corresponding locking surfaces 158 and 159 are positioned above the opening 114. The corresponding locking surfaces 158 and 159, however, are not engaged with their respective primary locking edges 130 and 132. Because the corresponding locking surfaces do not engage the primary locking edges, the tag 100 is movable in the upward direction.

While the tag 100 is movable in the unlocked position, it cannot be freely moved in this position. In the unlocked position, the tag 100 is frictionally latched to the neck portion 154 by way of at least one secondary locking edge 134. The first secondary locking edge 134 prevents the tag 100 from being moved freely. In one embodiment, upward force is applied at the bottom end 104 of the tag 100 to overcome the frictional force that latches the tag 100 to the neck portion 154. In an alternative embodiment, the tag 100 is pulled from the top end 102 to overcome the friction force that latches the tag 100 to the neck portion 154 in the unlocked position. In this regard, the tag 100 can be pulled by hand to remove the tag 100 in the unlocked position but not in the locked position.

In the unlatched or removed position, the tag 100 is not affixed to the neck portion 154. In one embodiment, the tag 100 is completely removed from the hanger 150. In another embodiment, the tag 100 rests above the neck portion 154 after a hook is passed through the opening 114 of the tag 100. In this regard, the removed position is the position in which the tag 100 can be moved freely in any direction relative to frame 152 of the hanger 150.

Before describing the other features of tag 100 illustrated in FIGS. 1A-1D more fully, it should be noted as a general matter that the tag 100 (top end 102, bottom end 104, and the body portion 106) is made of a flexible material that is resiliently expandable. Resiliently expandable means that when the tag 100 is able to expand from an original dimension to an expanded dimension without breaking under the stress of expansion, and returns to substantially its original dimension. The material of the tag 100 can be made of any common injection moldable plastic, and need only have sufficient resilience to allow the tag 100 to be expanded repeatedly and return to substantially its original shape repeatedly. To explain by way of an example, in one embodiment as the tag 100 is attached to a neck portion of a hanger, the opening 114 expands such that the lateral opening width 144 increases to a first temporarily increased lateral opening dimension. After the neck portion 154 of the hanger 150 is pushed through the opening 114, the opening 114 immediately returns to its original dimensions such that the first temporarily increased lateral opening dimension decreases to the lateral opening width 144.

To explain by way of another example, after the tag 100 is attached and locked to the neck portion of a hanger, when the tag 100 is rotated or twisted about the neck portion 154 of the hanger 150, the lateral opening width 144 increases to a second temporarily increased lateral opening dimension as the tag 100 is rotated about the neck portion 154. In one embodiment, the second temporarily increased lateral opening dimension is equal to the diagonal opening dimension 146 of the tag 100. After the tag 100 is rotated by 90 degrees, the opening 114 immediately returns to its original dimensions such that the second temporarily increased lateral opening dimension decreases to the lateral opening width 144.

Now returning to FIGS. 1A-1D, the tag 100 is shown in a removed or unlatched position. The tag 100, as noted above, includes a top end 102, a bottom end 104, and a body portion 106. The body portion 106 connects the top end 102 to the bottom end 104 and that the top end 102 and bottom end 104 are at least partially open: the top end 102 includes an opening 114 and the bottom end 104 includes an opening 116 (shown in FIG. 1C).

In one embodiment, the body portion 106 includes a plurality of inclined side walls 108, a plurality of parallel side walls 110, and a plurality of beveled walls 112. As shown in FIGS. 1A-1D, the body portion 106 includes two inclined sidewalls 108, two parallel side walls 110, and four beveled walls 112. The two inclined side walls 108 slope upwards from the bottom end 104 to the top end 102 such the length of the parallel sidewalls 110 at the bottom end 104 is greater than the length of the parallel sidewall 110 at the top end 102. Each inclined side wall 108 is connected to the parallel sidewall 108 by way of a beveled wall 112. The opening 116 that contours the general shape of the sidewalls 108, 110, and beveled walls 112.

The resulting configuration of the tag 100 is that of a hollow trapezoidal shaped prism that has no protrusions on the inside walls of the tag 100. As shown in FIG. 1D, the tag 100 has an internal cavity with no protrusions within the internal cavity.

It should be understood that the body portion 106 need not be in the shape of a trapezoidal shaped prism and that body portion may have other shapes. For instance, in one embodiment, the beveled walls 112 are curved so there are no straight edges on the body portion 106. In another embodiment, the body portion 106 is in the shape of a hollow rectangular shaped prism. In yet another embodiment, the inclined sidewalls 108 may be connected directly to one of the parallel sidewalls 110 without first connecting to the beveled walls 112.

The top end 102 includes a plurality of inwardly directed tabs (hereinafter referred to as tabs) and at least one primary locking edge. As shown in FIG. 1B, the top end 102 includes four tabs: 118, 120, 122, and 124. In one embodiment, the inwardly directed tabs include a planar surface, wherein the inwardly directed tabs define a portion of the opening 114. The top end 102 also includes two connecting tabs: a first connecting tab 126 and a second connecting tab 128. The top end 102 includes at least two primary locking edges: a first primary locking edge 130, a second primary locking edge 132. The top end 102 also includes at least four secondary locking edges: a first secondary locking edge 134, a second secondary locking edge 136, a third secondary locking edge 148, and a fourth secondary locking edge 140. The top end 102 also includes a plurality of expansion edges 142 and two expansion slots 149.

The first and second primary locking edges 130 and 132 engage with corresponding locking surfaces on a neck portion of a hanger. In the locked position, the first and second primary locking edges 130 and 132 extend below the corresponding locking surfaces such that the corresponding locking surfaces extend over and above the first and second primary locking edges 130 and 132. The configuration prevents the tag 100 from being moved in the locked position.

In contrast to the primary locking edges 130 and 132, the secondary locking edges 134, 136, 138, and 140 do not engage with the corresponding locking surfaces 158 and 159 on the neck portion 154. Rather, the secondary locking edges 134, 136, 138, and 140 frictionally latch the tag 100 in the unlocked position.

Unlike the primary locking edges 130 and 132 and the secondary locking edges 134, 136, 138, and 140 of the tag 100, the plurality expansion edges 142 do not come in contact with a standard neck portion 154 during attachment and removal of the tag 100. However, the cut-out defined by the edges 142 may engage an alternative neck with which the tag 100 may be used. Further, the expansion slots 149 are openings on both sides of the top end 102 which allows the tag 100 to expand without breaking or cracking as the tag 100 is locked to the neck portion 154 or unlocked from the neck portion 154. The slots 149 provide the tag 100 with an opening in the top of the tag that allows the tag to flex (beyond what the material alone provides) without cracking at the top of the inclined side walls 108, when the vertical sidewalls 110 separate during twisting of the tag.

In one embodiment, tabs 118 and 120 are located on an upper half of the tag 100 and tabs 122 and 124 are located on a lower half of the tag 100. In this embodiment, tabs on the upper half of the tag 100 (tabs 122 and 124) are connected to each other by the first connecting tab 126. The first connecting tab 126 includes the first primary locking edge 130. Similarly, tabs on the lower half of the tag 100 (tabs 122 and 124) are connecting to each other by the second connecting tab 128. The second connecting tab 128 includes the second primary locking edge 132.

The general dimensions of the tag 100 and the neck portion 154 should be noted. The opening 114 of tag 100 that has a lateral opening width 144, a diagonal opening dimension 146, and a height dimension 148. The opening 114 defined by the at least one inwardly directed tab, at least one of the primary and secondary locking edges, at least one of the expansion edges 142, at least one of the expansion slots 149. The lateral opening width 144 is the distance between the primary locking edges 130 and 132 when the tag 100 is in the removed position. The diagonal opening dimension 146 is the distance between two oppositely facing secondary locking edges (e.g., the distance between secondary locking edges 134 and 136). The height dimension 148 is the height of the tag from the top end 102 to the bottom end 104. As shown in FIGS. 2A-2B, the neck portion 154 of hanger 150 has a neck diagonal dimension 160, a neck width dimension 162, and a locking surface height dimension 164. As shown in FIG. 2, the neck diagonal dimension 160 is the diagonal width of the neck portion 154. The neck width dimension 162 is the width of the neck portion 154 from the top of each corresponding locking surfaces 158 and 159, and locking surface height dimension 164 is the distance from a base of the neck portion 154 to the locking surfaces 158 and 159. In one embodiment, the locking surface height dimension 164 is within the range of 15.1 mm to 15.2 mm and the neck width dimension 162 is within the range of 7.95 mm to 8.05 mm, and the height dimension 148 of tag 100 is within the range of 14.82 mm-14.92 mm.

Comparing dimensions of the tag 100 with the neck portion 154, the lateral opening width 144 is smaller than the neck width dimension 161 in all three positions (locked, unlocked, and removed). Because the neck width dimension 162 is greater than the lateral opening width dimension 144, the opening 114 expands to allow the corresponding locking surface through the opening 114 when locking the tag 100 to the neck portion 154 and once in the locked position, the corresponding locking surfaces extend over the primary locking edges of the tag 100.

Further, the locking surface height dimension 164 is slightly greater than the height dimension of the tag 100. The difference in height allows the corresponding locking surfaces 158 and 159 to extend pass the opening 114 of the tag 100 and allows the tag 100 to fit snugly between the base 151 and the corresponding locking surfaces 158 and 159.

In addition, the diagonal opening dimension 146 of the tag 100 is at least equal to the diagonal dimension 160 of the neck portion 154 for all three positions, which allows the neck portion 154 to fit snugly within the opening 114 when being attached and in the locked position.

Figure 3A:
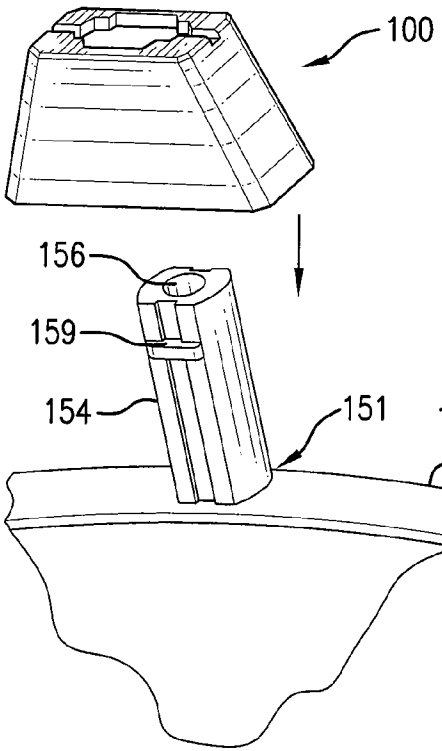
FIGS. 3A-3C illustrate the steps for attaching the snap-on-twist-off tag to the neck portion of a hanger.
Figure 3B:
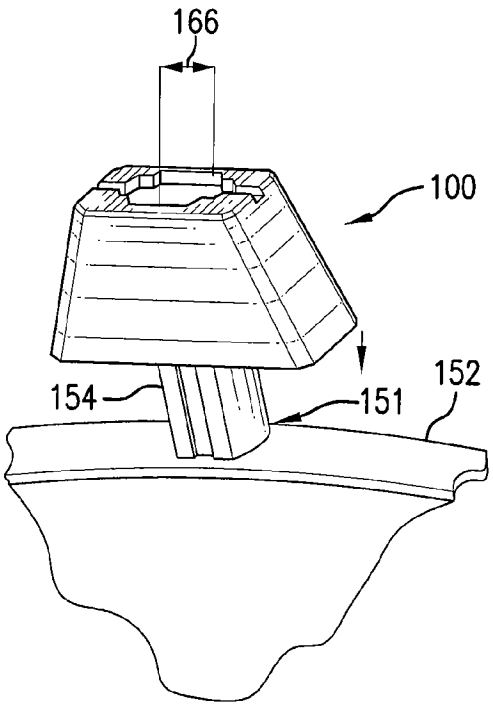
Figure 3C:
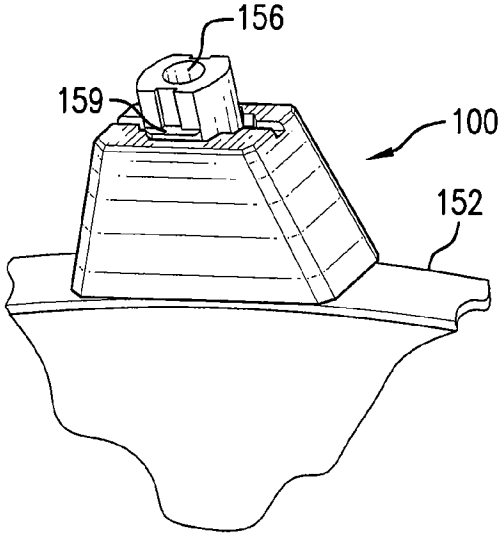

Turning to FIGS. 3A-3C, the steps for snapping-on or attaching the exemplary tag 100 to a neck portion 152 are shown. FIGS. 3A-3C use the same reference numerals used to describe the tag 100 in connection with FIGS. 1A-1D and the hanger 150 and neck portion 154 in FIGS. 2A-2B. In FIG. 3A, the tag is in a removed or unlatched position. In this position, the tag 100 is not affixed to the neck portion 154. In this position, the opening 114 has a lateral opening width 144 and a diagonal opening dimension 146. The tag 100 is positioned above the neck portion 154. The body portion 106 is aligned so that it is in parallel with the frame 152 of the hanger 150.

In FIG. 3B, the tag 100 is pushed downwards towards to the base 151 of the hanger 150. As the tag is pushed downwards, the opening 114 expands such that the lateral opening width 144 increases to a first temporarily increased lateral opening dimension 166. When the corresponding locking surfaces 158 and 159 are pushed through the opening 114, the temporarily increased lateral opening dimension 166 equals at least the neck width dimension 162 of the neck portion 154, thereby allowing the corresponding locking surfaces 158 and 159 to be pushed through the opening 114.

In FIG. 3C, the tag 100 is in the locked position as the corresponding locking surfaces 158 and 159 are fully engaged with the first and second primary locking edges 130 and 132. In this position, the opening 114 has a lateral opening width 110. In this regard, by the time tag 100 is pushed all the way down to the base 151 so that it is locked to the neck portion 154 (i.e., from the position in FIG. 3B to the position in FIG. 3C), the opening 114 decreases from the first temporarily increased lateral opening dimension 166 to the lateral opening width 144. In one embodiment, the steps illustrated in FIGS. 3A-3C occur in one smooth motion such that the tag 100 snaps on to the neck portion 154 of the hanger 150.

Figure 4C:
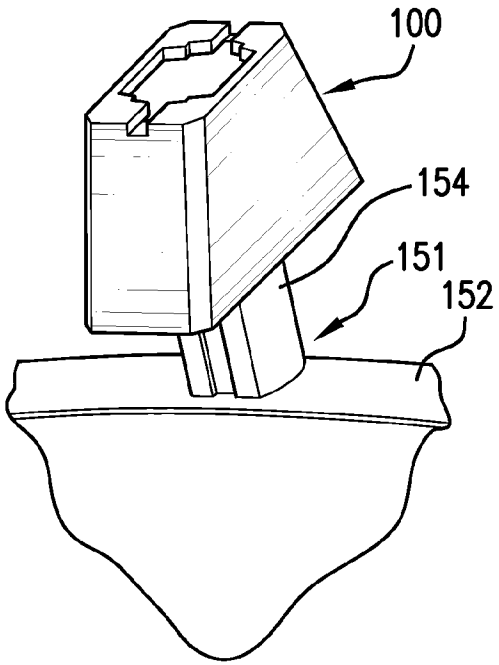
FIGS. 4A-4C illustrate the steps for removing the snap-on-twist-off tag from the neck portion of the hanger.
Figure 4B:
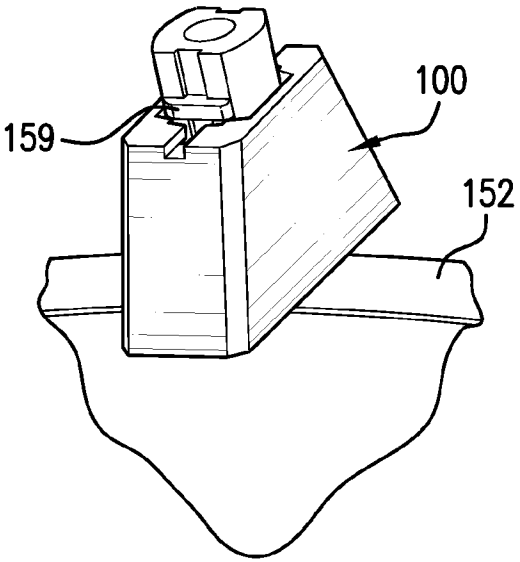
Figure 4A:
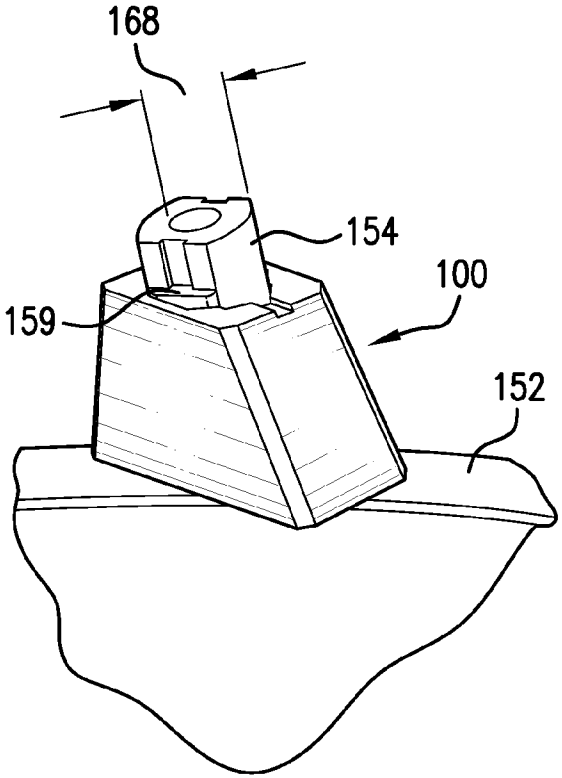

FIGS. 4A-4C illustrate the steps for removing the tag 100 from the neck portion 154. FIGS. 4A-4C use the same reference numerals used to describe the tag 100 in connection with FIGS. 1A-1D and the hanger 150 and neck portion 154 in FIGS. 2A-2B. In FIG. 4A, the tag 100 is rotated about the neck portion 154. As the tag 100 is rotated, the opening 114 expands such that the lateral opening width 144 increases to a second temporarily increased lateral opening width dimension 168. In one embodiment the second temporarily lateral opening width dimension 168 is equal to at least the diagonal opening dimension 146. As noted above, the diagonal opening dimension 146 is equal to at least the neck diagonal dimension 160 of the neck portion 164.

In FIG. 4B, the tag 100 is in the unlocked position after it has been rotated or twisted by 90 degrees from the locked position (i.e., the position of tag 100 in FIG. 4C). In the unlocked position, the opening 114 has a lateral opening width 144. In this regard, when the tag 100 is rotated 90 degrees from the position in FIG. 4C (i.e, the locked position) to the position in FIG. 4B (i.e, unlocked position), the opening 114 first increases from the lateral opening width 144 to a second temporarily lateral opening width dimension 168, which then returns or decreases to the lateral opening width 114. In FIG. 4B, the tag 100 is frictionally latched to the neck portion 164 by way of secondary locking edges 134, 136, 138, and 140. In this position, the tag 100 can be pulled upwards from the top end 102 or pushed upwards from the bottom end 104 to remove the tag 100 from the neck portion 154. In FIG. 4C, the tag is removed from the neck portion 164. In FIG. 4C, the opening 114 does not change dimensions.

Figure 5:
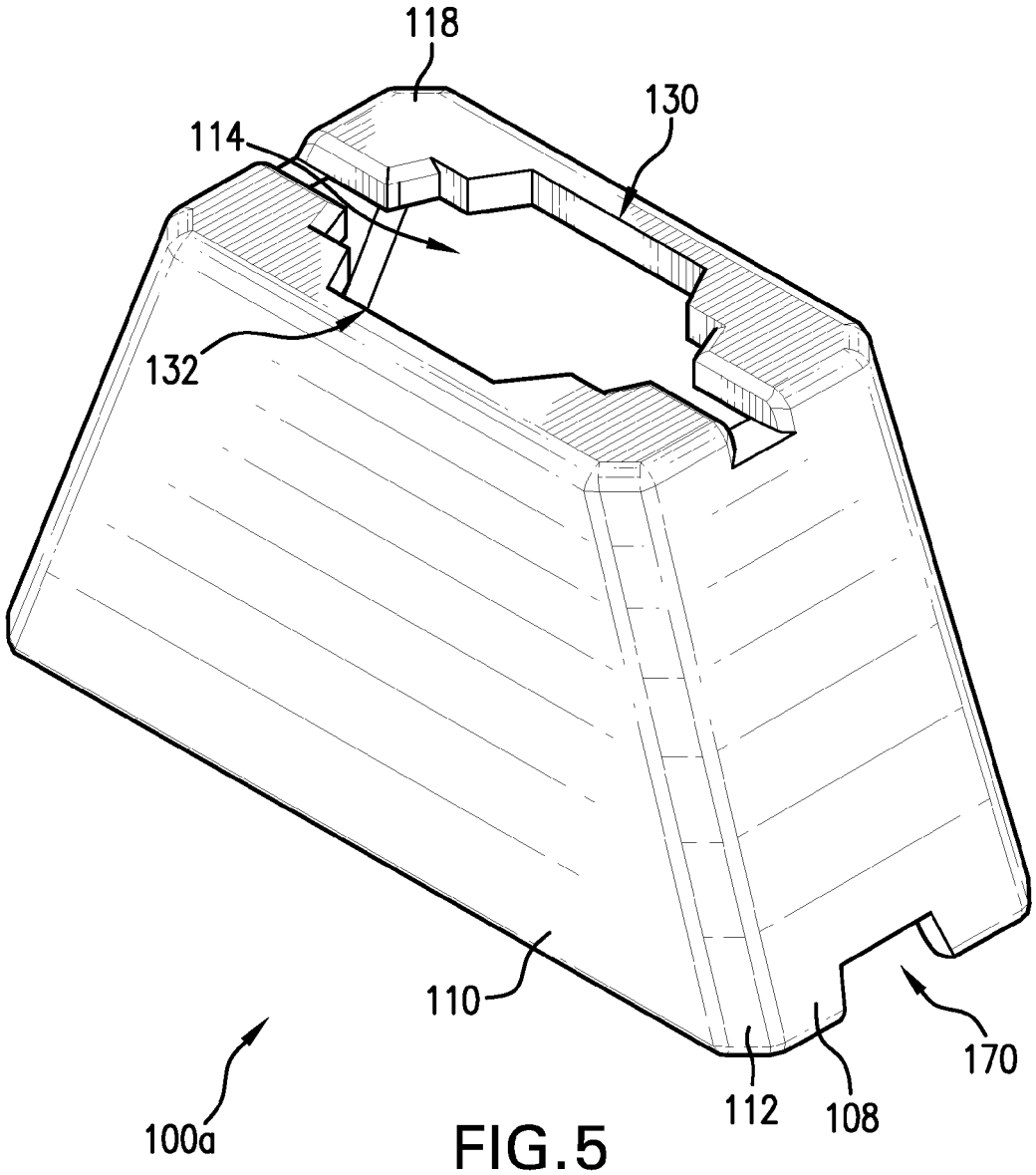
FIG. 5 is a perspective view of a tag according to an alternative embodiment.

The tag 100 may include other features as well not illustrated in FIGS. 1A-1D. As an example, FIG. 5 illustrates a snap-on-twist-off tag 100*a* (referred to as tag 100*a*) that includes a tool-hole 170 in one of the inclined sidewalls 108. Tool-hole 170 allows a removal tool to be inserted to remove the tag 100 from the locked position without twisting or rotating the tag 100. It should noted that apart from tool-hole 170, tag 100*a* has all of the same features as tag 100 in FIGS. 1A-1D and therefore these features are not explained. For purposes of illustration, a few of the structures of tag 100*a* have reference numerals associated with it. These reference numerals in FIG. 5 correspond to the same reference numerals of tag 100 in FIGS. 1A-1D.

Figure 6A:
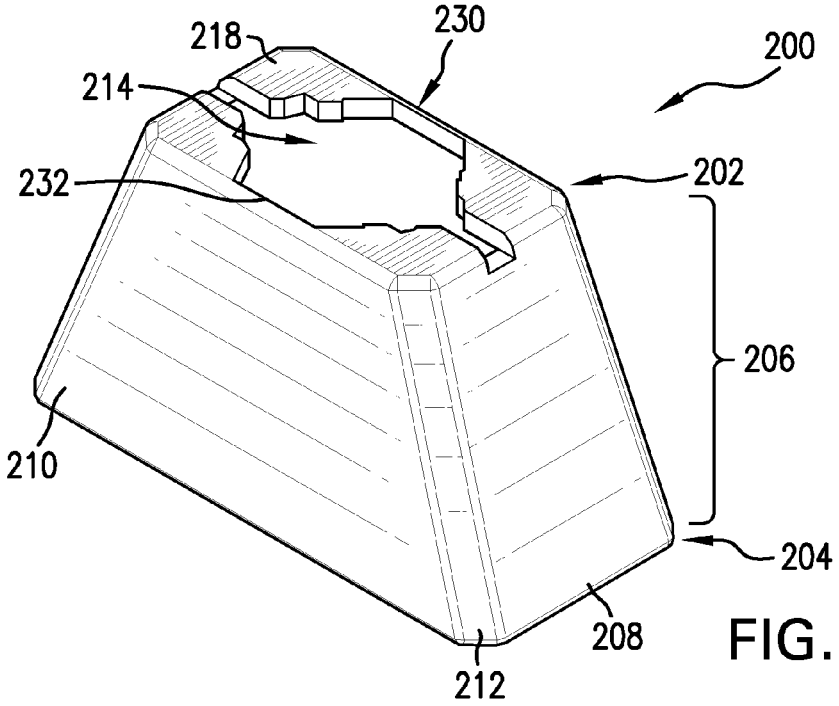
FIG. 6A is a perspective view of a tag according to an alternative embodiment.
Figure 6B:
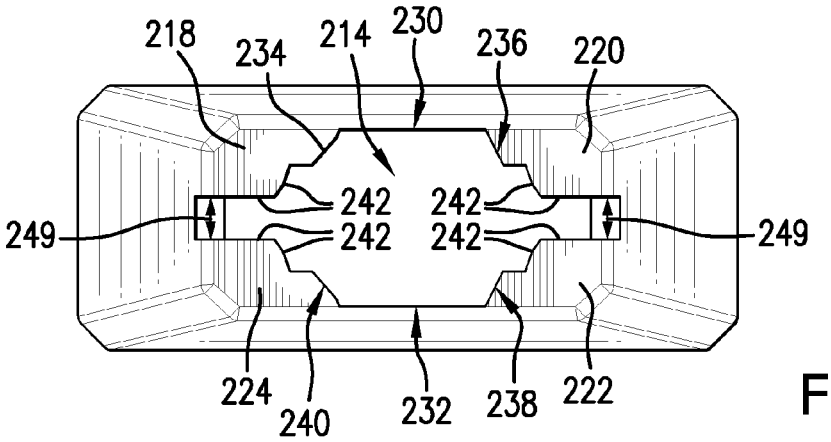
FIG. 6B is a top elevational view of a tag according to an alternative embodiment.
Figure 6C:
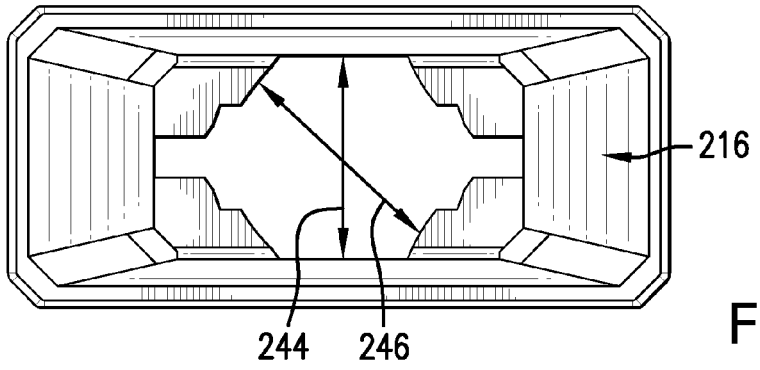
FIG. 6C is a rear elevational view of a tag according to an alternative embodiment.
Figure 7:
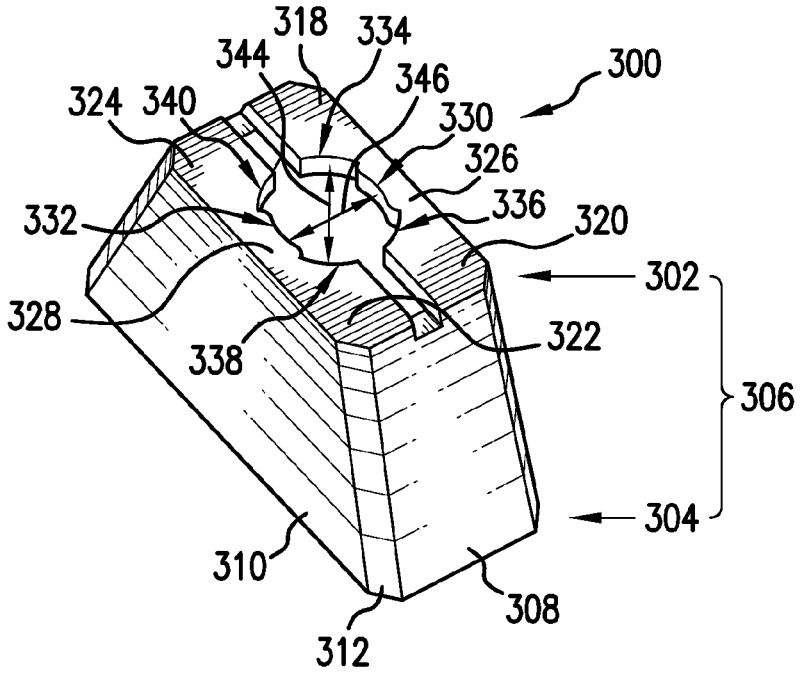
FIG. 7 is a perspective view of a tag according to an alternative embodiment.

Further, it should be understood that tag 100 is not limited to the design and shape illustrated in FIGS. 1A-1D. FIGS. 6 and 7 illustrate other exemplary embodiments of the snap-on-twist-off tag. In describing the other exemplary embodiments, three-digit reference numerals are used. Where structures similar to the embodiment described in connection with FIGS. 1A-1D are present in FIGS. 6 and 7, the tens digit and units digit of the reference numerals are chosen to correspond to the tens digit and units digit reference numerals used to describe the embodiment of tag 100 in FIGS. 1A-1D.

Referring to FIG. 6, an exemplary snap-on-twist-off tag 200 (hereinafter referred to as a "tag 200" or "sizer 200") is shown in perspective view. The tag 200 includes a top end 202, a bottom end 204, and a body portion 206. The body portion 206 connects the top end 202 to the bottom end 204 and that the top end 202 and bottom end 204 are at least partially open: the top end 202 includes an opening 214 and the bottom end 204 includes an opening 216 (shown in FIG. 2C).

In one embodiment, the body portion 206 includes a plurality of inclined side walls 208, a plurality of parallel sidewalls 210, and a plurality of beveled walls 212. As shown in FIGS. 6A-6C, the body portion 206 includes two inclined sidewalls 208, two parallel side walls 210, and four beveled walls 212. The two inclined side walls 208 slope upwards from the bottom end 204 to the top end 202 such the length of the parallel sidewalls 210 at the bottom end 204 is greater than the length of the parallel sidewall 210 at the top end 102. Each inclined side wall 208 is connected to the parallel sidewall 208 by way of a beveled wall 212. The opening 216 that contours the general shape of the sidewalls 208, 210, and beveled walls 212.

The resulting configuration of the tag 200 is that of a hollow trapezoidal shaped prism that has no protrusions on the inside walls of the tag 200. As shown in FIG. 2C, the tag 200 has an internal cavity with no protrusions within the internal cavity.

The top end 202 includes a plurality of inwardly directed tabs (hereinafter referred to as tabs) and at least one primary locking edge. As shown in FIG. 6B, the top end 202 includes four tabs: 218, 220, 222, and 224. The top end 202 includes at least two primary locking edges: a first primary locking edge 230, a second primary locking edge 232. The top end 202 also includes at least four secondary locking edges: a first secondary locking edge 234, a second secondary locking edge 236, a third secondary locking edge 248, and a fourth secondary locking edge 240. The top end 202 also includes a plurality of expansion edges 142 and two expansion slots 249.

In contrast to the tag 100, tag 200 does not include any connecting tabs (shown in FIG. 1B). Rather, a portion of the top end 202 of the body portion 206 comprises the first and second primary locking edges 230 and 232. In this regard, the first and second primary locking edges 230 and 232 engage with corresponding locking surfaces on a neck portion of a hanger. In the locked position, the first and second primary locking edges 230 and 232 extend below the corresponding locking surfaces such that the corresponding locking surfaces extend over and above the first and second primary locking edges 230 and 232. The configuration prevents the tag 200 from being moved in the locked position.

The secondary locking edges 234, 236, 238, and 240 do not engage with the corresponding locking surfaces 158 and 159 on the neck portion 154. Rather, the secondary locking edges 134, 136, 138, and 140 frictionally latch the tag 200 in the unlocked position.

Unlike the primary locking edges 230 and 232 and the secondary locking edges 234, 236, 238, and 240 of the tag 200, the plurality expansion edges 242 do not come in contact with the neck portion 254 during attachment and removal of the tag 200. However, the cut-out defined by the edges 242 may engage an alternative neck with which the tag 200 may be used. Further, the expansion slots 249 are openings on both sides of the top end 202 which allows the tag 200 to expand without breaking or cracking as the tag 200 is locked to the neck portion 154 or unlocked from the neck portion 154. The slots 249 provide the tag 200 with an opening in the top of the tag that allows the tag to flex (beyond what the material alone provides) without cracking at the top of the inclined side walls 208, when the vertical sidewalls 210 separate during twisting of the tag.

In one embodiment, tabs 218 and 220 are located on an upper half of the tag 200 and tabs 222 and 224 are located on a lower half of the tag 200. Unlike tag 100 in FIGS. 1A-1D, tabs in the upper half are not connected to each other by way of a connecting tab and the tabs in the lower half are not connected to each other by way of a connecting tabs.

The general dimensions of the tag 200 and the neck portion 154 should be noted. The opening 214 of tag 200 that has a lateral opening width 244, and a diagonal opening dimension 146. The lateral opening width 244 is the distance between the primary locking edges 230 and 232 when the tag 200 is in the removed position. The diagonal opening dimension 246 is the distance between two oppositely facing secondary locking edges (e.g., the distance between secondary locking edges 234 and 236).

Comparing dimensions of the tag 200 with the neck portion 154, the lateral opening width 244 is smaller than the neck width dimension 261 in all three positions (locked, unlocked, and removed). Because the neck width dimension 262 is greater than the lateral opening width dimension 244, the opening 214 expands to allow the corresponding locking surface through the opening 214 when locking the tag 200 to the neck portion 254 and once in the locked position, the corresponding locking surfaces extend over the primary locking edges of the tag 200.

Further, the locking surface height dimension 264 is slightly greater than the height dimension of the tag 200. The difference in height allows the corresponding locking surfaces 158 and 159 to extend pass the opening 214 of the tag 100 and allows the tag 200 to fit snugly between the base 151 and the corresponding locking surfaces 158 and 159.

In addition, the diagonal opening dimension 246 of the tag 200 is at least equal to the diagonal dimension 160 of the neck portion 154 for all three positions, which allows the neck portion 154 to fit snugly within the opening 214 when being attached and in the locked position.

Referring to FIG. 7, an exemplary snap-on-twist-off tag 300 (hereinafter referred to as a "tag 300" or "sizer 300") is shown in perspective view. The tag 300 includes a top end 302, a bottom end 304, and a body portion 306.

The body portion 306 connects the top end 302 to the bottom end 304 and that the top end 302 and bottom end 304 are at least partially open: the top end 302 includes an opening 314 and the bottom end 304 includes an opening at the bottom end (not shown in FIG. 7). The body portion 306 includes a plurality of inclined side walls 308, a plurality of parallel sidewalls 310, and a plurality of beveled walls 312. The resulting configuration of the tag 300 is that of a hollow trapezoidal shaped prism that has no protrusions on the inside walls of the tag 300. The 300 has an internal cavity with no protrusions within the internal cavity. (not shown in FIG. 7).

The top end 302 includes a plurality of inwardly directed tabs (hereinafter referred to as tabs) and at least one primary locking edge. As shown in FIG. 7, the top end 302 includes four tabs: 318, 320, 322, and 324. The top end 302 includes at least two primary locking edges: a first primary locking edge 330, a second primary locking edge 332. The top end 302 also includes two connecting tabs: a first connecting tab 326 and a second connecting tab 328. The top end 302 also includes at least four secondary locking edges: a first secondary locking edge 334, a second secondary locking edge 336, a third secondary locking edge 348, and a fourth secondary locking edge 340. The top end 302 includes two expansion slots 349 (shown in FIG. 8).

The first and second primary locking edges 330 and 332 engage with corresponding locking surfaces on a neck portion of a hanger. In the locked position, the first and second primary locking edges 330 and 332 extend below the corresponding locking surfaces such that the corresponding locking surfaces extend over and above the first and second primary locking edges 330 and 332. The configuration prevents the tag 300 from being moved in the locked position.

In contrast to the primary locking edges 330 and 332, the secondary locking edges 334, 336, 338, and 340 do not engage with the corresponding locking surfaces on the neck portion 154. Rather, the secondary locking edges 334, 136, 138, and 140 frictionally latch the tag 100 in the unlocked position. The expansion slots 349 (shown in FIG. 8) are openings on both sides of the top end 302 which allows the tag 300 to expand without breaking or cracking as the tag 300 is locked to the neck portion 154 or unlocked from the neck portion 154. The slots 349 provide the tag 300 with an opening in the top of the tag that allows the tag to flex (beyond what the material alone provides) without cracking at the top of the inclined side walls 308, when the vertical sidewalls 310 separate during twisting of the tag.

In one embodiment, tabs 318 and 320 are located on an upper half of the tag 300 and tabs 322 and 324 are located on a lower half of the tag 300. In this embodiment, tabs on the upper half of the tag 300 (tabs 322 and 324) are connected to each other by the first connecting tab 326. The first connecting tab 326 includes the first primary locking edge 330. Similarly, tabs on the lower half of the tag 300 (tabs 322 and 324) are connecting to each other by the second connecting tab 328. The second connecting tab 328 includes the second primary locking edge 332.

FIG. 9 illustrates a tag and hanger combination in which the tag 300 (of FIG. 7) attaches a to a neck portion 354. As noted above when describing FIG. 7, the tag 300 includes a first and second primary locking edges 330 and 332 and tag 300 includes four secondary locking edges 336, 338, 340, and 342. As shown in FIG. 8, the neck portion 354 of a hanger includes at least corresponding locking surface 358 to lock a tag to the neck portion 354. The neck portion 354 also includes at least one guiding surface 384. In the unlocked position, the guiding surface 354 guides a tag as it is moved upwards to remove it form the neck portion 354.

As shown in FIG. 8, the neck portion 354 has an indentation which forms the corresponding locking 358 that is at right angles to the surface of the neck portion 354. In one embodiment, the neck portion 354 includes at least two corresponding locking surfaces: a first corresponding locking surface 358 and a secondary corresponding locking surface (not shown in FIG. 8) that is opposite and directly across from the first corresponding locking surface 358. In the same or different embodiment, the neck portion 354 includes at least two guiding surfaces: a first guiding surface 384 and second guiding surface (not shown in FIG. 8) that is opposite and directly across from the first guiding edge 384.

In the locked position, as shown by line 392, the first primary locking surface 330 engages with the first corresponding locking surface 358 and second primary locking edge 332 engages a second corresponding locking surface (not shown) of neck portion 354. In this locked position, the corresponding locking surfaces of the neck portion 354 extend over the first and second primary locking edges 330 and 332. This prevents the tag 300 from being moved upwards. In the unlocked position, the tag 300 is rotated by 90 degrees from the locked position. As the tag 300 is rotated, the opening 314 expands such that the lateral opening width 344 increases to a temporarily increased lateral opening width. In one embodiment, the temporarily increased lateral opening width is at least equal to the diagonal opening dimension 346. By the time the tag is rotated 90 degrees (i.e., is in the unlocked position), the opening 314 decreases from the temporarily increased lateral opening width to the lateral opening width 344. In the unlocked position, as shown by line 390, the first primary locking edge 330 engages with the guiding surface 384 of the neck portion 354. The guiding surface 384 allows the tag 300 to be moved upwards to remove it from the neck portion 354.

Note the corresponding locking surfaces on a neck portion of a hanger need not be protrusions as illustrated in FIG. 2. As shown in FIG. 8, an indentation in the neck portion 354 forms a corresponding locking surface 358 that is at right angles to the surface of the neck portion 354.

Although the inventions described and claimed herein have been described in considerable detail with reference to certain embodiments, one skilled in the art will appreciate that the inventions described and claimed herein can be practiced by other than those embodiments, which have been presented for purposes of illustration and not of limitation. Therefore, the spirit and scope of the appended claims should not be limited to the description of the embodiments contained herein.

We claim:

1. A push-on-twist-off tag for a hanger, the tag comprising:

a top end, a bottom end, and a body portion connecting the top end and the bottom end;

the top end having at least one inwardly directed tab and at least one primary locking edge adapted to lock the tag to a corresponding locking surface on a neck portion of the hanger; and an opening adjacent to the at least one inwardly directed tab adapted to receive the neck portion of the hanger, the opening having a lateral opening width and a diagonal opening dimension, wherein the body is resiliently expandable in a direction of the lateral opening width to unlock the tag, such that the lateral opening width increases to a temporarily increased lateral opening dimension equal to at least the diagonal opening dimension upon rotation of the tag about the neck portion of the hanger to unlock the tag.

2. The tag of claim 1, wherein the top end comprises an at least partially open top end;

the bottom end comprises an at least partially open bottom end; and the body comprises an at least partially sloping body portion.

3. The tag of claim 1, wherein the at least one inwardly directed tab comprises at least four inwardly directed tabs, wherein each inwardly directed tab is on opposite ends of the top end.

4. The tag of claim 1, wherein the top end comprises an upper half and a lower half, wherein:

the upper half includes two inwardly directed tabs on opposite ends of the of the upper half and a upper connecting tab, wherein the upper connecting tab connects the two inwardly directed tabs, wherein the upper connecting tab includes a first primary locking edge; and the lower half includes two inwardly directed tabs on opposite ends of the lower half and a lower connecting tab, wherein the lower connecting tab connects the two inwardly directed tabs, wherein the lower connecting tab includes a second primary locking edge.

5. The tag of claim 1, wherein the lateral opening width of the opening corresponds to a width of the neck portion of the hanger and wherein the diagonal opening dimension of the opening corresponds to a diagonal dimension of the neck portion of the hanger when the tag is locked to the neck portion of the hanger.

6. The tag of claim 5, wherein after the tag is rotated, the lateral opening width and diagonal opening dimension return to same lateral opening width and diagonal opening dimension before the tag was rotated.

7. The tag of claim 1, wherein the tag is hollow such that the tag has no protrusions on an interior wall of the body portion; and the bottom end having an open base.

8. The tag of claim 1, wherein the tag is in the shape of a hollow prism with an open base at the bottom end.

9. The tag of claim 8, wherein the hollow prism is in the shape of a hollow trapezoidal prism.

10. The tag of claim 8, wherein the hollow prism includes at least two parallel sidewalls, each of which is connected to at least two inclined sidewalls, wherein each of the at least two inclined sidewalls faces each other.

11. The tag claim 10, wherein when the at least two parallel sidewalls are squeezed towards each other, the at least one primary locking edge exerts pressure on the corresponding locking surface on a neck portion of the hanger.

12. The tag of claim 11, wherein the tag cannot be removed from the neck portion of the hanger by squeezing the two parallel sidewalls towards each other without damaging the tag.

13. The tag of claim 10, wherein the tag cannot be removed from the neck portion of the hanger by pulling on the body portion of the twist tag without damaging the tag.

14. The tag of claim 1, wherein the at least one primary locking edge is made of a flexible injection moldable plastic.

15. The tag of claim 1, wherein the at least one inwardly directed tab includes a planar surface, and wherein the at least one inwardly directed tab defines a portion of the opening.

16. The tag of claim 1, wherein the top end further includes at least one secondary locking edge adapted to hold the tag to the neck portion of the hanger after the tag is rotated about the neck portion of the hanger to unlock the tag.

17. The tag of claim 16, wherein the opening is defined by the at least one inwardly directed tab and at least one of the primary and secondary locking edges.

18. The tag of claim 1, wherein the tag cannot be removed from the neck portion of the hanger without twisting the tag.

19. The tag of claim 1, wherein the tag cannot be removed from the neck portion of the hanger by squeezing the body portion of the tag without damaging the tag.

20. The tag of claim 19, wherein when the body portion is squeezed, the at least one primary locking edge and the corresponding locking surface exert pressure on each other to prevent the tag from being unlocked.

21. The tag of claim 1, wherein the tag cannot be removed from the neck portion of the hanger by pulling on the body portion of the tag without damaging the tag.

22. The tag of claim 1, wherein the body portion at the bottom end has a hole for fitting a tool.

23. A hanger and snap-on-twist-off tag combination:

a hanger comprising a body, a boss, and a hook; and a tag comprising:

a top end, a bottom end, and a body portion connecting the top end and the bottom end;

the top end having at least one inwardly directed tab and at least one locking edge adapted to lock the tag to the boss of the hanger;

an opening adjacent to the locking surface adapted to receive the boss, the opening having a lateral opening width that corresponds to a width of the boss and a diagonal opening dimension that corresponds to a diagonal dimension of the boss, wherein the body portion of the tag is resiliently expandable in a direction of the lateral opening width, such that the lateral opening width increases to a temporarily increased lateral opening dimension equal to at least the diagonal opening dimension upon rotation of the tag about the boss to unlock the tag.

24. The hanger and snap-on-twist-off tag combination of claim 23, wherein the boss includes a corresponding locking surface.

25. The hanger and snap-on-twist-off tag combination of claim 24, wherein the corresponding locking surface is portion of an indent in the boss.

26. The hanger and snap-on-twist-off tag combination of claim 24, wherein the corresponding locking surface is a portion of a protrusion in the boss.

* * * * *